United States Patent [19]

Siemon et al.

[11] Patent Number: 4,753,093

[45] Date of Patent: Jun. 28, 1988

[54] PLANARITY CONTROL IN THE ROLLING OF FLAT STOCK

[75] Inventors: Bernhard Siemon, Duesseldorf; Heinz Teichert, Langenfeld, both of Fed. Rep. of Germany

[73] Assignee: Mannesmann AG, Duesseldorf, Fed. Rep. of Germany

[21] Appl. No.: 766,112

[22] Filed: Aug. 15, 1985

[30] Foreign Application Priority Data

Aug. 16, 1984 [DE] Fed. Rep. of Germany ..... 3430034

[51] Int. Cl.[4] ..... B21B 37/00

[52] U.S. Cl. ..... 72/8; 72/11; 72/17; 72/20; 72/201; 72/243

[58] Field of Search ..... 72/8, 17, 6, 20, 16, 72/9, 12, 243, 245, 234, 16, 201

[56] References Cited

U.S. PATENT DOCUMENTS

| | | | |
|---|---|---|---|
| 3,568,637 | 3/1971 | Smith, Jr. | 72/8 |
| 3,630,055 | 12/1971 | Fapiano et al. | 72/6 |
| 3,855,830 | 12/1974 | Kitanosono et al. | 72/16 X |
| 3,934,438 | 1/1976 | Arimura et al. | 72/12 X |
| 4,125,004 | 11/1978 | Alshuk | 72/16 X |
| 4,244,025 | 1/1981 | Alshuk | 72/16 X |
| 4,292,825 | 10/1981 | Morooka et al. | 72/8 |
| 4,513,594 | 4/1985 | Ginzburg et al. | 72/8 |
| 4,537,050 | 8/1985 | Bryant et al. | 72/243 X |

FOREIGN PATENT DOCUMENTS

| | | | |
|---|---|---|---|
| 0011103 | 2/1981 | Japan | 72/12 |
| 0006713 | 1/1983 | Japan | 72/234 |

*Primary Examiner*—Robert L. Spruill
*Assistant Examiner*—Steven Katz
*Attorney, Agent, or Firm*—Ralf H. Siegemund

[57] ABSTRACT

A conventional planarity control system with feedback loop is used but augmented by a lead function having its principal input actually occuring rolling force and variations thereof under consideration of the statistical relationship between rolling force and bending force of working, intermediate or support rolls.

2 Claims, 1 Drawing Sheet

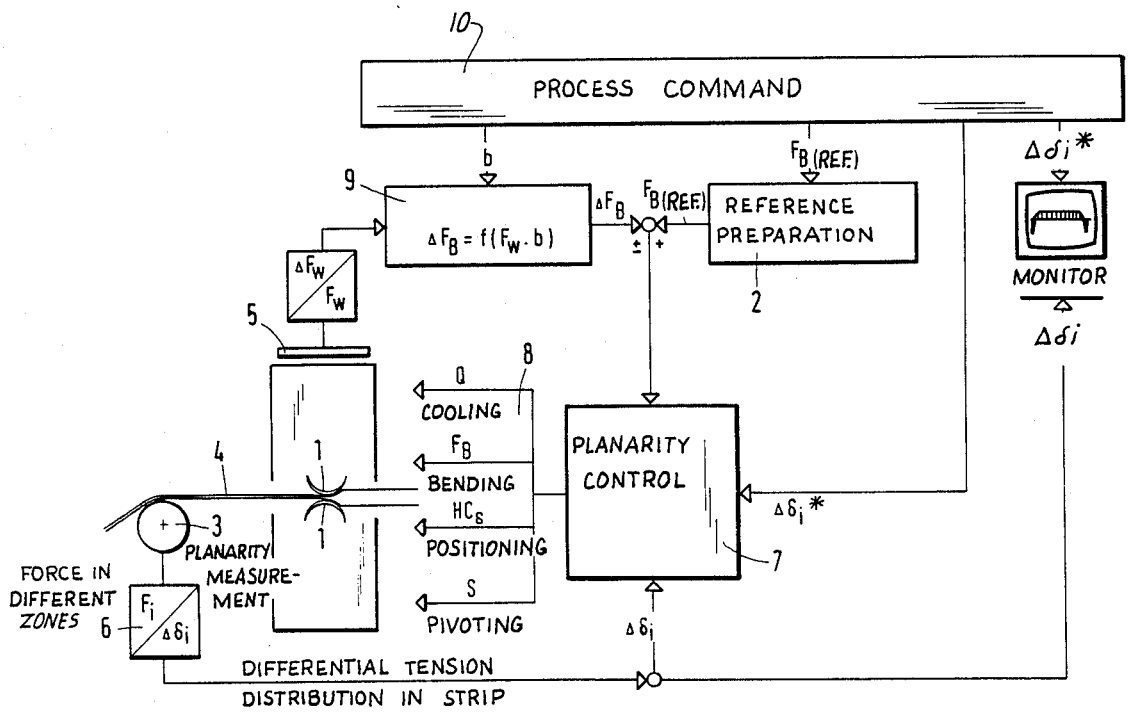

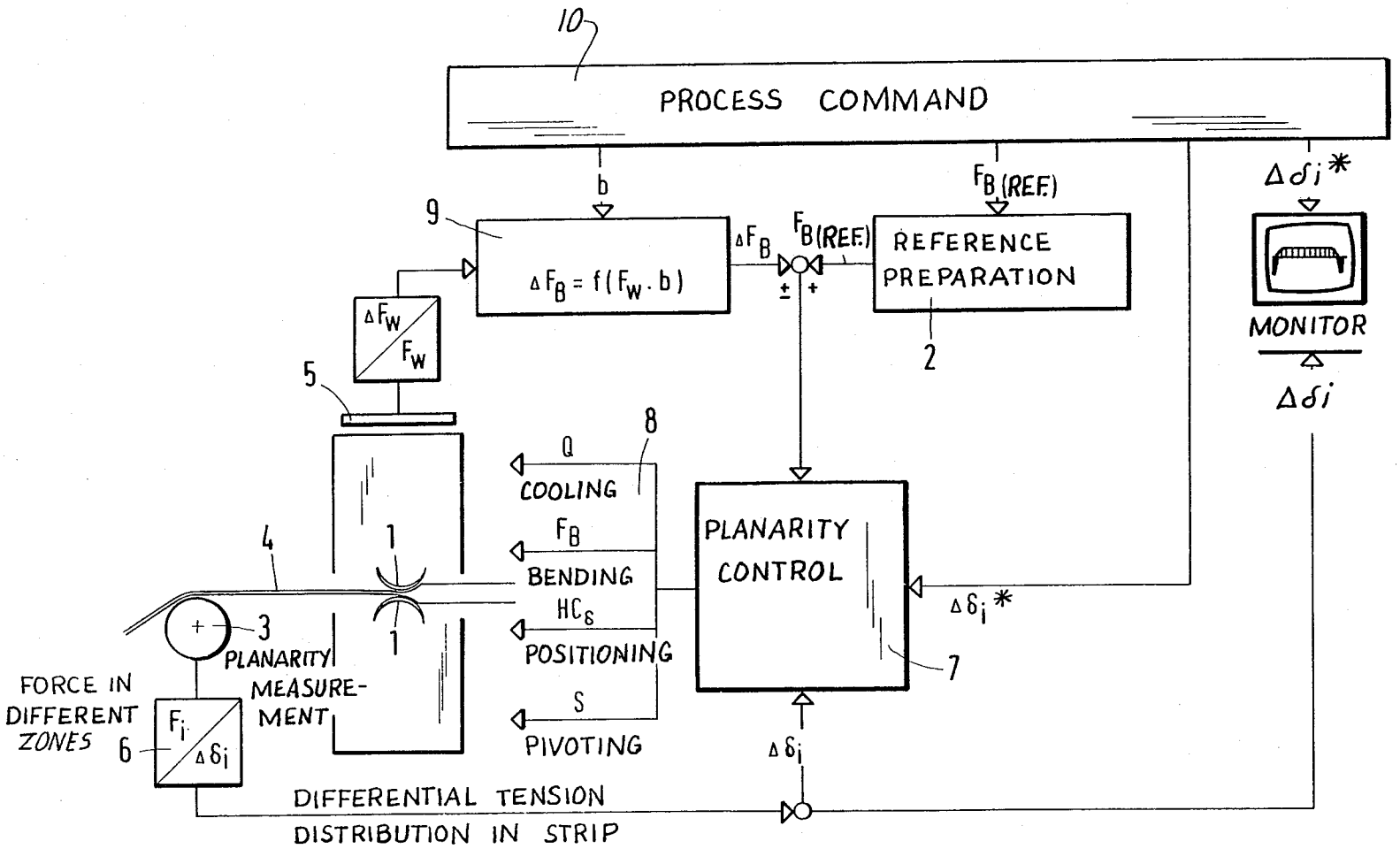
PROCESS COMMAND
10
b
$\Delta\delta_i^*$
MONITOR
$\Delta\delta_i$
$F_{B(REF)}$
REFERENCE PREPARATION
2
$F_{B(REF)}$
$\Delta F_B$
$\pm$
$\Delta F_B = f(F_W, b)$
9
$\Delta F_W$
$F_W$
5
$\Delta\delta_i^*$
7
PLANARITY CONTROL
$\Delta\delta_i$
8
Q
COOLING
$F_B$
BENDING
$HC_S$
POSITIONING
S
PIVOTING
1
1
4
3
PLANARITY MEASURE-MENT
$F_i$
$\Delta\delta_i$
6
FORCE IN DIFFERENT ZONES
DIFFERENTIAL TENSION
DISTRIBUTION IN STRIP

PLANARITY CONTROL IN THE ROLLING OF FLAT STOCK

BACKGROUND OF THE INVENTION

The present invention relates to automatic feedback control of the planarity of rolled stock, and more particularly the invention relates to such a control device which includes measuring equipment for measuring planarity and adjusting structure for eliminating defects and errors in planarity under utilization of desired values being inputed either manually or can be called up automatically.

During the rolling of flat stock and only after the onset of rolling and only after a thread-in phase will the rolling speed be increased to the normal operating speed. In most materials such a change in speed is equivalent to a change in deforming speed will experience a change in internal strength and resistance which has to be considered. Generally speaking any change in rolling speed goes hand-in-hand with a change in rolling force. This change in rolling force in turn changes the thickness of the flat stock. Therefore, it is necessary to control in some fashion the rolling process by keeping the thickness of the roll stock constant through the control of the rolling force. The rolling force being therefore an adjustment parameter by means of which the thickness of the rolled stock can be varied. However, the problem is more complex. The desired qualities are not obtainable simply through modifying the rolling force unless a companion deformation, being an elastic one, of the working or the support rolls in the mill stand are taken into consideration. Therefore, whenever change occurs in the profile of the strip or rolled stock cross section one has to expect some interference with overall planarity.

Generally speaking it is known to provide a closed loop feedback type of control to eliminate the effect changes in the rolling force have on the planarity of the rolled stock. This procedure requires ascertaining any errors or deviation of planarity by an appropriate measuring system. The measurement of planarity may be carried out by instruments of a contact variety or of the noncontact variety; the measuring method may operate indirectly by ascertaining planarity for example through measuring the internal tension in the strip or by providing some indication of any waviness in the surface of the rolled stock.

Whatever mode of measurement one employs there is the inherent defect or detriment that the planarity based on the type of measurement used can be ascertained only at a certain distance from the rolling gap. In other words the error in planarity has well occurred and may already persist to some extent before it can be recognized in the flat stock as emerging from the rolling mill. The known system, moreover, is capable of determining errors in planarity as they are produced in the rolling gap only on a compounded integrated basis so that any feedback control principles taking this integration into consideration are not sensitive and are in fact unsuitable to offset e.g. temporary errors in planarity as they may occur for example on the basis of temporary speed variations or strip tension variations as they produce temporary changes in the rolling force. For this reason it is customary for instance to turn the feedback control loop off during the beginning stages of rolling and during threading of the rolled stock throught the mill. Instead, the (human) operator will manipulate the process during these stages based on his experience and visual impression and with whatever success he can master.

DESCRIPTION OF THE INVENTION

It is an object of the present invention to avoid the aforedescribed problems as well as deficiencies of known control systems for the planarity of flat rolled stock and to provide a new and improved control method and equipment for maintaining constant the thickness of flat rolled stock under conditions which make sure that the planarity of the stock remains constant even if the rolling force i.e. the resistance against the formation of the rolled stock changes.

In accordance with the preferred embodiment of the present invention it is suggested to provide an automatic feedback control for the planarity of rolled stock is constructed conventionally in that conventional measurements are made to ascertain the actual existing planarity by way of a representative measurements and to be compared with a desired or reference value for modifying the force of rolling in accordance with any ascertained difference. Specifically now this feedback loop is improved and supplemented by means of a leading control in which a theoretically or through previous measurements ascertained corrective value is superimposed upon the effective rolling force and changes thereof. This introduction is preferably carried out through a feedback loop which combines a corrective value representative with programmed change.

The invention is based on the recognition of the fact that there is a dependancy between the rolling force and the elastic deformation of any of the rolls involved such as the working rolls paper, intermediate rolls and/or support rolls, and that the plastic deformation of the rolled stock is theoretically ascertainable at least in an approximating fashion so that the leading control on the basis of the distance between the rolled gap on one hand and the measurement of planarity on the other hand, one can eliminate the resulting delay that is inherent in a planarity control system being of course the basic control system also employed here. Thus, planarity errors are already compensated at the location of generation before they occur to a noticeable degree so that changes in the planarity of the rolled stock in the case of temporary speed changes or the like can be suppressed. Changes in the planarity of the rolled stock which are on a long term basis such as changes in the profile of the preceding strip or environmental thermal effect are still removed by the included conventional control system.

In accordance with a particularly advantageous feature of the invention it is suggested to ascertain the requisite corrective value under consideration of the construction and dimensions of the rolling stand as well as the width and the profile of the stock and the requisite rolling force. Taking all these parameters into consideration the rolling process can be simulated and we may obtain here a particular characteristic between planarity and rolling force. The method uses changes in rolling force for the leading control within the loop under utilization of these characteristics in that under consideration of the geometry of the rolled stock (profile and width) one really produces a change in bending force of the participating rolls (working rolls, intermediate rolls, support rolls) in accordance with characteristics and under utilization of a process control computer, so that in the case of actually recurring rolling force variations, the rolled stock still maintains its constant width i.e. its planarity.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

the FIGURE is a block diagram for explaining the inventive planarity control system in accordance with the preferred embodiment for the practicing the best mode of the invention.

Proceeding to the detailed description of the drawings the FIGURE illustrates working rolls 1 in a strip or skelp rolling stand or frame and it is assumed that the unrolled stock or previously rough rolled stock 4' is processed in the mill stand to obtain flat and comparatively thin strip stock 4. Reference numeral 3 refers to a measuring roller above whch the stock 4 passes in contact, therewith and which is provided to ascertain the planarity of that stock. Conventional techniques are used in this regard and are adopted here. It is assumed that the roller 3 furnishes values $F_i$ indicative of planarity and fed to a control circuit 6 by means of which planarity as such is ascertained represented by delta delta i. This actually measured value delta delta i is compared in a planarity control system 7 with a reference value delta delta i* furnished by a suitable process pilot and the command system 10. This controller 7 is, as far as these two inputs are concerned, conventional; it operates adjusting channels 8 in which selectively the cooling Q of the rolling process is modified or the bending force $F_B$ is modified; all the rolls are repositioned (HCdelta) or the rolls are pivoted about a vertical axis corresponding to a pivot value S.

In addition the frame is provided with a transducer 5 which ascertains and measures directly the force of rolling $F_W$ as well as the changes in such force delta $F_W$. In accordance with the present invention the rolling force $F_W$ as well as the change of force delta $F_W$ are fed to a stage 9 which in other words acquires at any instant the effective rolling force and its temporal derivative thereof. By means of either simulation, calculation or actual measurements, relations have been ascertained linking the rolling force and changes of the rolling force with desirable parameter changes, namely a change in bending force delta $F_B$ to be used as supplement and modifier of the desired value $F_B$ provided by the stage 7. Moreover a summing network adds a desired value for the bending force of working, intermediate and/or support rolls to the particular value provided by the stage 9. This reference value $F_B$ is provided either by the pilot and master control system 10 or manually through an appropriate preparatory stage 2. It considers particularly the differences between the onset period of rolling and the subsequent steady state phase. This particular supplemental value, delta $F_B+F_B$(ref) provides a kind of anticipatory control in that it introduces into the controller 7 a corrective value even before the measuring device 6 has actually ascertained the occurence of a planarity deviation. The value delta $F_B$ therefore provides a kind of statistical average of changes expected to occur under normal or average conditions and these are introduced to simulate an error by modifying the then existing desired reference value for planarity, delta delta i*. In effect then the planarity errors will not materialize and will occur only in case of deviation from the statistical average. The principal control for planarity therefore, and as exerted here, is based on the anticipatory control provided by the stage 9 which introduces the potential sources of errors as a control parameter such that the planarity deviation will not materialize. The circuit which is used as the primary control circuit is based on measuring the planarity (stages 3 and 6) but that loops becomes a secondary feature being provided merely to eliminate either long term variations or deviations from the statistical average. The inventive anticipatory control is of course effective during the entire rolling operation but it was found that its principal function really occurs in the initial phases of threading the stock into and through the rolling mill as well as in the end phases so that planarity changes even in the onset and final phases can be eliminated through the control. This includes in particular those planarity changes which are attributable to the speed modification that occurs in the initial and onset phases.

It should be mentioned that in addition the preparation of the requisite characteristics provided by the stage 9 is preferably carried out by means of simulation which in turn has been set up on the basis of sampled data and are used in a model with an EDV device. Herein a comparison occurs between theoretically ascertained sections with the desired sections and through approximating methods those adjusting values are ascertained which will lead to the best possible agreement between these desired and actual values in surface and profile curves of the flat stock being rolled. In particular one obtains value pairs rolling force and bending force which are statistically referenced and sorted on the basis of sampling with the rolling stock. The resulting plot is a cloud of dots and by means of calculated interpolation is superimposed in order to obtain a statistically averaged relationship between strip width and bending force. It was found that actually the relationship is a linear one, represented by the factor b in the FIGURE which of course makes the formation of a requisite corrective value delta $F_B$ particularly simple.

The invention is not limited to the embodiments described above but all changes and modifications thereof, not constituting departures from the spirit and scope of the invention, are intended to be included.

We claim:

1. In a control circuit for maintaining planarity of flat rolled stock as rolled in a rolling stand said rolling stand exerting a particular bending force upon the stock being rolled, the control circuit including equipment for measuring planarity of the stock being rolled, means for providing desired values of planarity, and means connected to said equipment and means, for controlling a rolling process in dependence upon deviation between a desired value of planarity and an actual value of planarity and including particularly means for controlling parameters of and in the rolling stand to obtain the requisite correction, the improvement comprising:

a control circuit including a bending force reference signal source;

means (i) connected to the rolling stand for ascertaining the actually effective rolling force as exerted upon said rolled stock in said rolling stand and for ascertaining variations of said force;

means (ii) connected to the means for ascertaining, and providing (a) a signal representing particular corrective characteristics and providing (b) a rolling process corrective output in response to said signal; and means connected to the means (ii) and to the control circuit for introducing said corrective value as a modifier of the bending force reference signals in the control circuit, for modifying the ascertained difference between desired and actual values of planarity said modifier being effective as an anticipatory control action, anticipating ascertainment of planarity deviations before they actually occur thereby tending and on an empirical statistical average basis, to thereby remove causes for lack of planarity before they occur and are ascertained.

2. The improvement as in claim 1 wherein said means for ascertaining as connected introducing said corrective modifier value as a modification of said bending force reference value.

* * * * *